US007491315B2

(12) United States Patent
Eng et al.

(10) Patent No.: US 7,491,315 B2
(45) Date of Patent: Feb. 17, 2009

(54) DUAL RISER FCC REACTOR PROCESS WITH LIGHT AND MIXED LIGHT/HEAVY FEEDS

(75) Inventors: Curtis N. Eng, Houston, TX (US); Rik B. Miller, Stillwater, OK (US)

(73) Assignee: Kellogg Brown & Root LLC, Houston, TX (US)

( * ) Notice: Subject to any disclaimer, the term of this patent is extended or adjusted under 35 U.S.C. 154(b) by 232 days.

(21) Appl. No.: 11/503,042

(22) Filed: Aug. 11, 2006

(65) Prior Publication Data

US 2008/0035527 A1 Feb. 14, 2008

(51) Int. Cl.
*C10G 11/00* (2006.01)

(52) U.S. Cl. ..... 208/113; 208/71; 208/73; 208/79; 208/80; 208/155; 208/159; 208/164; 208/288; 208/288 S; 585/648; 585/649; 585/650; 585/651; 585/653

(58) Field of Classification Search ..... 208/71, 208/73, 79, 80, 113, 115, 159, 164, 288, 208/288 S, 155; 585/648, 649, 650, 651, 585/653

See application file for complete search history.

(56) References Cited

U.S. PATENT DOCUMENTS

| | | | | |
|---|---|---|---|---|
| 3,407,789 | A | 10/1968 | Hallee | |
| 3,647,682 | A | 3/1972 | Rabo | |
| 3,758,403 | A | 9/1973 | Rosinski | |
| 3,785,782 | A | 1/1974 | Cartmell | |
| 3,820,955 | A | 6/1974 | Woebcke | |
| 3,856,659 | A * | 12/1974 | Owen | 208/80 |
| 4,311,579 | A * | 1/1982 | Bartholic | 208/73 |
| 4,404,095 | A | 9/1983 | Haddad | |
| 4,419,221 | A | 12/1983 | Castagnos, Jr. | |
| 4,499,055 | A | 2/1985 | DiNicolantonio | |
| 4,814,067 | A | 3/1989 | Gartside | |
| 4,828,679 | A | 5/1989 | Cormier, Jr. | |
| 4,980,053 | A | 12/1990 | Li | |
| 5,026,935 | A | 6/1991 | Leyshon | |
| 5,026,936 | A | 6/1991 | Leyshon | |
| 5,043,522 | A | 8/1991 | Leyshon | |

(Continued)

OTHER PUBLICATIONS

Eng, Curtis et al., "Economic routes to propylene," Hydrocarbon Asia, Jul./Aug. 2004, pp. 36-45, vol. 14 No. 4, AP Energy Business Publications PTE LTD, Singapore.

(Continued)

*Primary Examiner*—Glenn Caldarola
*Assistant Examiner*—Prem C. Singh
(74) *Attorney, Agent, or Firm*—KBR IP Legal

(57) ABSTRACT

A dual riser FCC process is disclosed wherein first and second hydrocarbon feeds (5, 6) are supplied to the respective first and second risers (2, 4) to make an effluent rich in ethylene, propylene and/or aromatics. Where the hydrocarbon feeds are different, the respective risers can have different conditions to favor conversion to ethylene and/or propylene. A minor amount of a coke precursor (80, 82) can be added to one or both of the hydrocarbon feeds (5, 6) to reduce or eliminate the amount of supplemental fuel needed to heat balance the system. The different feeds, including the coke precursor and any recycle streams (36, 44) can be segregated by type to improve olefin yields, including an embodiment where the paraffinic feeds are supplied to one riser and the olefinic feeds to the other.

15 Claims, 3 Drawing Sheets

U.S. PATENT DOCUMENTS

| | | | | |
|---|---|---|---|---|
| RE33,728 | E | 10/1991 | Dean | |
| 5,326,465 | A | 7/1994 | Yongqing | |
| 5,523,502 | A | 6/1996 | Rubin | |
| 6,004,452 | A | 12/1999 | Ash | |
| 6,033,555 | A | 3/2000 | Chen | |
| 6,287,522 | B1 | 9/2001 | Lomas | |
| 6,791,002 | B1 * | 9/2004 | Abrevaya et al. | 585/648 |
| 7,011,740 | B2 | 3/2006 | Tallman | |
| 2004/0069681 | A1 | 4/2004 | Peterson et al. | |
| 2005/0150817 | A1 | 7/2005 | Tallman et al. | |

OTHER PUBLICATIONS

"MAXOFIN (TM): A Novel FCC Process for Maximizing Light Olefins using a New Generation of ZSM-5 Additive," Paper AM-98-18, Mar. 15-17, 1998, San Francisco, California.

"Future Refinery—FCC's Role in Refinery / Petrochemical Integration," Presented at 2001 NPRA Meeting, Mar. 18, 2001.

Hemler, Charles et al, "Maximizing FCC Production," PTQ, Summer 1999, pp. 31-35.

* cited by examiner

DUAL RISER FCC REACTOR PROCESS WITH LIGHT AND MIXED LIGHT/HEAVY FEEDS

CROSS REFERENCE TO RELATED APPLICATIONS

FIELD

The embodiments relate generally to operations of dual-riser fluidized catalytic cracking (FCC) units to produce olefins and/or aromatics from one or more light hydrocarbon feedstocks. The embodiments relate generally to methods of employing the segregation and/or commingling of light and/or heavy hydrocarbon feedstocks.

BACKGROUND

This background is a general discussion of basic fluid catalytic cracking (FCC) technology used in refineries to maximize yields for transportation fuels such as gasoline and distillates. The FCC process uses a reactor called a riser, essentially a pipe, in which a hydrocarbon feed gas is intimately contacted with small catalyst particles to effect the conversion of the feed to more valuable products. The FCC unit converts gas oil feeds by "cracking" the hydrocarbons into smaller molecules. The resulting hydrocarbon gas and catalyst mixture both flow in the riser, hence the term fluid catalytic cracking.

As employed in today's refineries, the FCC unit can convert primarily heavy feeds (such as vacuum gas oils, reduced crudes, atmospheric tower bottoms, vacuum tower bottoms and the like), into transportation fuel products (such as gasoline, diesel, heating oils, and liquefied petroleum gases). To increase yields from the FCC unit of more valuable petrochemicals, such as ethylene and propylene, refineries are operating at high severity and/or using light feedstocks such as light cracked naphtha in the riser to co-crack with heavy feeds.

The cracking reaction is endothermic, meaning that heat must be supplied to the reactor process to heat the feedstock and maintain reaction temperature. During the conversion process with heavy feeds, coke is formed. The coke is deposited on the catalyst and ultimately burned with an oxygen source such as air in a regenerator. Burning of the coke is an exothermic process that can supply the heat needed for the cracking reaction. The resulting heat of combustion from regeneration increases the temperature of the catalyst, and the hot catalyst is recirculated for contact with the feed in the riser, thereby maintaining the overall heat balance in the system. In balanced operation, no external heat source or fuel is needed to supplement the heat from coke combustion. Should a heat imbalance exist, such as making too much coke and generating excessive heat for the reactions, it is possible to use a catalyst cooler or other process modifications in mitigation, especially with heavy feeds or high severity operation. As practiced today, the FCC unit primarily cracks gas oil and heavier feeds.

The prior art teaches some ways for converting of light feeds such as C4+olefinic and paraffinic streams to more valuable products, such as propylene. The processing of light feeds, generally with carbon numbers less than 12, poses its own unique issues with regards to two critical areas, namely maximizing the propylene and ethylene yields, and maintaining the heat balance with insufficient coke make. These issues become even more important as lighter feeds are contacted with catalysts formulated specifically for light feeds and higher ethylene and propylene production.

Unlike heavy feeds, light feeds do not make enough coke to maintain heat balance in the FCC unit. Thus, an external source of heat input is required to keep the FCC unit in heat balance when using predominantly light feeds. One solution has been to use an import fuel oil to remove catalyst fines from the riser reactor effluent, and combusting the imported fuel oil to heat balance the FCC unit.

To maximize the utilization of low value feeds within a refinery or petrochemicals complex, producers have introduced much lighter feeds into the FCC unit. Lighter feeds require a hotter riser temperature to crack efficiently, but when introduced in a small proportion into a heavy feed stream, will lead to even more coke production. This occurs because although the coke make from lighter feeds is significantly lower than for heavy feeds at the same temperature, the coke make from the heavy feed is increased at the higher operating temperatures. Conditions that maximize the production of propylene generally require relatively high temperatures that increase coke production, particularly from the heavy feed. Light feeds rarely make 1% coke, while the coke yield from heavy feeds could be as high as 10-15%. The excess coke from heavy feed under propylene-maximizing conditions would generally lead to a system heat imbalance, unless a catalyst cooler were used.

In the prior art, the use of the excess heat from the coke formed in the heavy feed riser to supply the heat of reaction required by the lighter feed can be supplied to a second riser is generally more efficient. Eng et al., "Economic Routes to Propylene," Hydrocarbon Asia, p. 36 (July/August 2004), discloses the production of transportation fuels from a heavy feed such as vacuum gas oil in a conventional FCC unit as a baseline. However, if the goal is to maximize petrochemicals, the FCC unit can use both heavy and light feeds. A dual riser reactor can be used. In the dual riser process, a light feedstock is supplied to one riser to produce the olefins that are desired, while a conventional resid or heavy feedstock is supplied to another riser to make gasoline and/or distillates. The catalyst from the dual risers is regenerated in a common regenerator. The heat from regenerating the coke deposits, primarily on the catalyst from the heavy feed riser, is balanced for operation of both risers. Since optimum cracking conditions for the heavy feed and light feed are usually much different, the complete segregation of a heavy feed from a light feed cracked in dual risers leads to benefits in yields and operation.

Integration of gas oil and light olefin catalytic cracking zones with a pyrolytic cracking zone to maximize efficient production of petrochemicals allows production of an overall product stream with maximum ethylene and/or propylene by routing various feedstreams and recycle streams to the appropriate cracking zone(s), e.g. ethane/propane to the steam pyrolysis zone, waxy gas oil to a high severity cracking zone and C4-C6 olefins to the light olefin cracking zone, enhancing the value of the material balances produced by the integrated units.

Processes for catalytically and non-catalytically cracking hydrocarbon feedstocks are well known. Steam cracking in a furnace and contact with hot non-catalytic particulate solids are two well-known non-catalytic cracking processes. Fluid catalytic cracking and deep catalytic cracking are two well-known catalytic cracking processes.

Deep catalytic cracking is a process in which a preheated hydrocarbon feedstock is cracked over a heated solid acidic catalyst in a reactor at temperatures ranging from about 500° C. to about 730° C.

BRIEF DESCRIPTION OF THE DRAWINGS

The detailed description will be better understood in conjunction with the accompanying drawings as follows.

Figure 1:
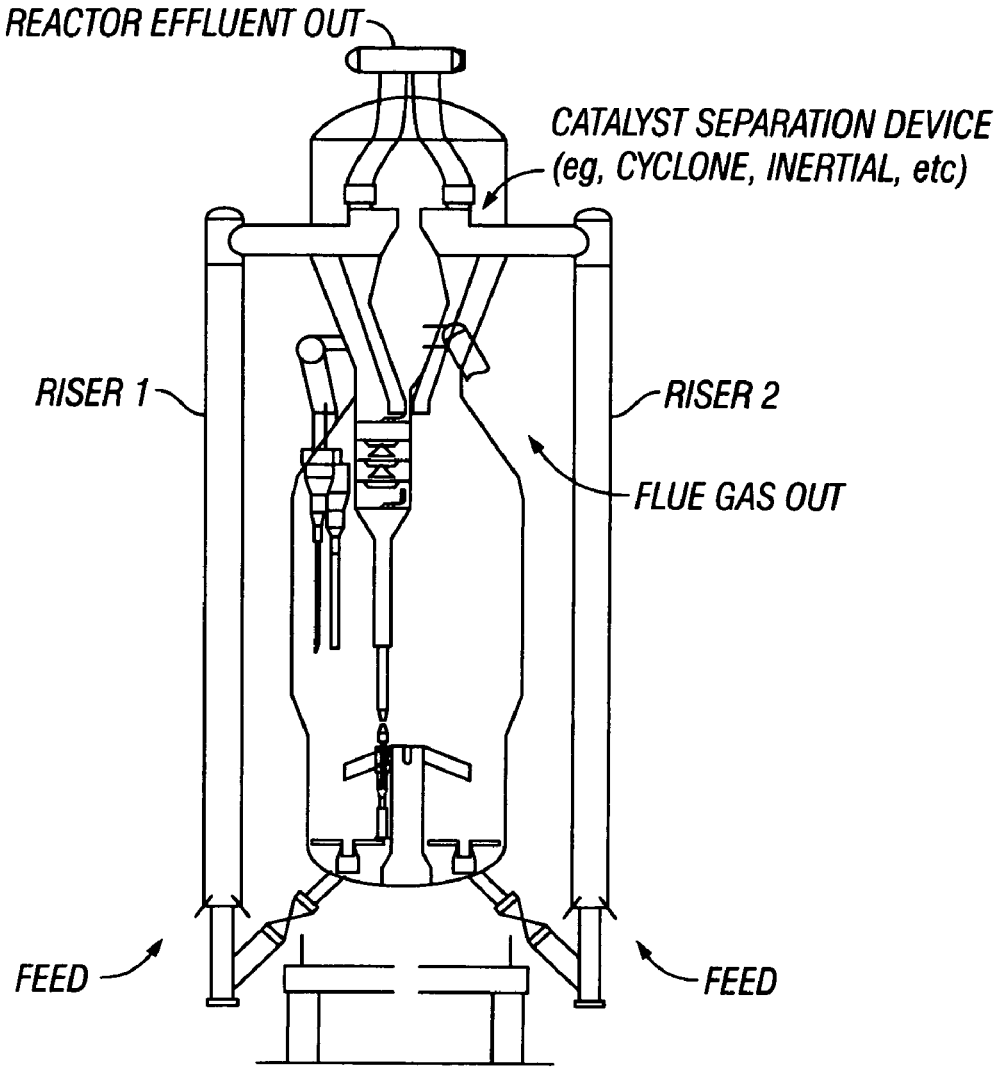
FIG. 1 is a schematic representation of a dual riser FCC reactor that can be used to process multiple light feeds.

The embodiments are detailed below with reference to the listed Figures.

DETAILED DESCRIPTION OF THE EMBODIMENTS

Before explaining the embodiments in detail, it is to be understood that the embodiments are not limited to the particular embodiments and that they can be practiced or carried out in various ways.

A dual riser FCC system can be used to process light hydrocarbons in both risers to favor olefin and/or aromatics production. Improvements are seen in selectivity and conversion by operating the risers at independently selected conditions depending on the nature of the light hydrocarbon feed. By segregating feeds to the risers, each feed can be processed at conditions that optimize olefin production. For different feeds, the appropriate riser conditions may be different, e.g. with segregated paraffinic and olefinic light hydrocarbon feeds, the riser receiving the paraffinic feed can have a higher temperature, higher catalyst-to-oil ratio, and lower hydrocarbon partial pressure than the riser to which the olefinic feed is supplied. Also, a coke precursor can be fed to one of the risers in a minor proportion to reduce or eliminate the amount of supplemental fuel used for regeneration to heat balance the system. The introduction of a coke precursor is beneficial when cracking predominantly light hydrocarbon feeds which otherwise would do not make enough coke to heat balance the reactor system. The coke precursor is supplied to the riser with the light hydrocarbon feed with which it is more compatible for olefin production.

In one embodiment, a dual riser FCC process includes: cracking a first light hydrocarbon feed in a first riser under first-riser FCC conditions to form a first effluent enriched in ethylene, propylene or a combination thereof; and cracking a second light hydrocarbon feed in a second riser under second-riser FCC conditions to form a second effluent enriched in ethylene, propylene or a combination thereof. The first and second light hydrocarbon feeds are different and the first-riser and second-riser FCC conditions are independently selected to favor production of ethylene, propylene or a combination thereof. The process further includes recovering catalyst and separating gas from the first and second FCC effluents, optionally in a common separation device. The recovered catalyst is regenerated from the first and second risers by combustion of coke in a regenerator to obtain hot, regenerated catalyst; and the hot regenerated catalyst can be re-circulated to the first and second risers to sustain a continuous operating mode.

The first and second light hydrocarbon feeds can be any hydrocarbon feedstock with light hydrocarbons having from four or more carbon atoms. Examples of these hydrocarbons include paraffinic, cycloparaffinic, monoolefinic, diolefinic, cycloolefinic, naphthenic, and aromatic hydrocarbons, and hydrocarbon oxygenates. Further representative examples include light paraffinic naphtha; heavy paraffinic naphtha; light olefinic naphtha; heavy olefinic naphtha; mixed paraffinic C4s; mixed olefinic C4s (such as raffinates); mixed paraffinic C5s; mixed olefinic C5s (such as raffinates); mixed paraffinic and cycloparaffinic C6s; non-aromatic fractions from an aromatics extraction unit; oxygenate-containing products from a Fischer Tropsch unit; or the like; or any combination thereof. Hydrocarbon oxygenates can include alcohols having carbon numbers ranging of one to four, ethers having carbon numbers of two to eight and the like. Examples include methanol, ethanol, dimethyl ether, methyl tertiary butyl ether (MTBE), ethyl tertiary butyl ether, tertiary amyl methyl ether (TAME), tertiary amyl ethyl ether and the like.

In an embodiment, the first and second light hydrocarbon feeds can be different. In an embodiment, the first-riser and second-riser FCC conditions can be different. The different conditions can include temperature, catalyst-to-oil ratio, hydrocarbon partial pressure, steam-to-oil ratio, residence time, or the like, or a combination thereof.

In an embodiment, the first light hydrocarbon can be olefinic and the second light hydrocarbon feed can be paraffinic. The second-riser FCC conditions can include a higher temperature, higher catalyst-to-oil ratio, and lower hydrocarbon partial pressure than the first-riser FCC conditions. In an embodiment, the second hydrocarbon feed can include a recycle stream recovered from the separated gas, which can include paraffinic and cycloparaffinic hydrocarbons having from four to twelve carbon atoms.

In an embodiment, the combustion of the coke can be in a common regenerator. Coke on the recovered catalyst is insufficient and the regeneration can include combustion of supplemental fuel introduced to the regenerator, to maintain a steady state heat balance. Examples of the supplemental fuel include be fuel oil, fuel gas, or the like.

In an embodiment, a coke precursor to the first or second riser with the respective first or second light hydrocarbon feed at a ratio of from 1 to 40 parts by weight coke precursor to 100 parts by weight fresh light hydrocarbon feed. The coke precursor can be acetylene, alkyl- or allyl-substituted acetylene, (such as methyl acetylene, vinyl acetylene, or the like), a diolefin (such as butadiene), or combinations thereof. In an embodiment, the process can include preparing the first light hydrocarbon feed by partially hydrogenating a diolefin-rich stream to obtain the first light hydrocarbon feed. As an example, the first light hydrocarbon feed can include monoolefins and from 0.05 to 20 or from 1 to 15 weight percent diolefins.

In an embodiment, the coke precursor can be a heavy hydrocarbon feed.

In an embodiment, the coke precursor can include an aromatic hydrocarbon or an aromatic precursor that forms aromatics in the cracking reactor, which is fed to the first riser with an olefinic feed. In this manner, the feed to the second riser is paraffinic, and the second riser operating conditions can include a higher temperature, higher catalyst-to-oil ratio, and/or lower hydrocarbon partial pressure relative to the first riser.

In an embodiment, the coke precursor can include a gas oil, which is fed to the second riser with a paraffinic feed. Where the feed to the first riser is olefinic, the second riser operating conditions with the paraffinic hydrocarbon/gas oil coke precursor feed can include a higher temperature, higher catalyst-to-oil ratio, and/or lower hydrocarbon partial pressure relative to the first riser.

In an embodiment wherein coke on the recovered catalyst from the light hydrocarbon feeds is insufficient by itself, the introduction of the coke precursor can provide additional coke make, so that the combustion of supplemental fuel, otherwise introduced to the regenerator as needed to maintain a steady state heat balance, can be reduced or eliminated. If desired, the introduction of the coke precursor may be controlled at a rate to provide additional coke make to maintain a steady state heat balance without supplemental fuel, or with a given rate of fuel supplementation.

In an embodiment, the dual riser process can include conditioning the gas separated from the first and second effluents to remove oxygenates, acid gases, water or a combination thereof to form a conditioned stream. The conditioned can be separated into at least a tail gas stream, an intermediate stream, and/or a heavy stream. As an example, the tail gas stream can include an ethylene product stream, a propylene product stream, a light stream comprising ethane, propane, or a combination thereof. As an example, the intermediate stream can include olefins selected from $C_4$ to $C_6$ olefins and mixtures thereof. As an example, the heavy stream can include $C_6$ and higher hydrocarbons. The intermediate stream can be recycled to the first riser. The heavy stream can be recycled to the second riser. The first and second effluents can be mixed and conditioned together in a common conditioning unit, or the first and second effluents can be conditioned separately. If desired, the process can further include: hydrotreating the heavy stream to obtain a hydrotreated stream; extracting a product stream comprising benzene, toluene, xylenes or a mixture thereof from the hydrotreated stream to obtain a raffinate stream lean in aromatics; and/or recycling the raffinate stream to the second riser.

As used herein, the term "light" in reference to feedstock or hydrocarbons generally refers to hydrocarbons having a carbon number less than 12, and "heavy" refers to hydrocarbons having a carbon number greater than 12. As used herein, "carbon number" refers to the number of carbon atoms in a specific compound, or in reference to a mixture of hydrocarbons the weight average number of carbon atoms.

As used herein, "naphtha" or "full range naphtha" refers to a hydrocarbon mixture having a 10 percent point below 175° C. (347° F.) and a 95 percent point below 240° C. (464° F.) as determined by distillation in accordance with the standard method of ASTM D86; "light naphtha" to a naphtha fraction with a boiling range within the range of $C_4$ to 166° C. (330° F.); and "heavy naphtha" to a naphtha fraction with a boiling range within the range of 166° C. (330° F.) to 211° C. (412° F.).

As used herein, the term "paraffinic" in reference to a feed or stream refers to a light hydrocarbon mixture comprising at least 80 weight percent paraffins, no more than 10 weight percent aromatics, and no more than 40 weight percent cyclo-paraffins.

As used herein, the term "aromatic" in reference to a feed or stream refers to a light hydrocarbon mixture comprising more than 50 weight percent aromatics.

As used herein, the term "olefinic" in reference to a feed or stream refers to a light hydrocarbon mixture comprising at least 20 weight percent olefins.

As used herein, the term "mixed $C_4$'s" in reference to a feed or stream refers to a light hydrocarbon mixture comprising at least 90 weight percent of hydrocarbon compounds having 4 carbon atoms.

As used herein the term "waxy gas oil" refers to a gas oil comprising at least 40 weight percent paraffins and having a fraction of at least 50 percent by weight boiling above 345° C.

As used herein, the term "dual riser" is used to refer to FCC units employing two or more risers. While operating complexity and mechanical design considerations can limit the dual riser FCC unit to two risers as a practical matter, a dual riser FCC unit can have three, four or even more risers. FIG. 1 is a schematic representation of a dual riser FCC reactor that can be used to process multiple light feeds.

As used herein, reference to a riser temperature shall mean the temperature of the effluent exiting at the top of the riser. Because the riser reactions are usually endothermic, the thermal equilibrium of the riser feeds (preheated hydrocarbon, steam and catalyst) may be higher than the riser exit temperature and the temperature will vary throughout the riser depending on the reactions.

As used herein, a catalyst-to-oil ratio shall mean the weight of catalyst to the weight of oil feed to the riser. Delta coke and/or coke make refer to the net coke deposited on the catalyst, expressed as a percent by weight of the catalyst. The proportion of steam in a feed refers to the proportion or percentage of steam based on the total weight of hydrocarbon feed to the riser (excluding catalyst).

In catalytic cracking, catalyst particles are heated and introduced into a fluidized cracking zone with a hydrocarbon feed. Example cracking zone temperatures are from about 425° C. to about 705° C. Example catalysts useful in fluidized catalytic cracking include Y-type zeolites, USY, REY, RE-USY, faujasite and other synthetic and naturally occurring zeolites and mixtures thereof. For the cracking of light feeds, zeolite catalysts can be used alone or in conjunction of other known catalysts useful in fluidized catalytic cracking, (such as, crystalline zeolite molecular sieves, containing both silica and alumina with other modifiers such as phosphorous). Crystalline aluminosilicates used in the cracking of light feeds are exemplified by ZSM-5 and similar catalysts.

The catalytic cracking processes described herein can include contacting the catalyst directly with a feedstock, forming a catalytically cracked product. The catalyst can be separated from the catalytically cracked product. A substantial amount of the hydrocarbon that remains with the separated coked catalyst can be then removed. The coke can then be combusted for catalyst reuse in the reaction.

The feedstock can be preheated from waste heat provided from downstream process fractionation steps including, but not limited to, the main fractionator pumparound systems. These main fractionator waste heat pumparound systems circulate fractionator streams comprising any or all of cracked gasoline and heavier oils to facilitate the removal of heat from critical sections of the fractionator. The feedstock preheat temperature prior to reaction can ranges from about 90° C. to about 370° C., but can be preheated up to 510° C. and supplied to the riser as vapor or a two-phase mixed vapor and liquid stream.

The preheated feedstock is contacted with a regenerated fluidized catalytic cracking catalyst provided at a temperature ranging from about 425° C. to about 815° C., and reacted through and within a riser reactor or fluidized bed reactor. For heavy feeds cracked to produce transportation fuels, the mixture of catalytic cracking catalyst and catalytically cracked hydrocarbon generally exit the riser reactor at a reaction temperature ranging from about 450° C. to about 680° C. The pressure of most modern fluid catalytic cracking processes can range from about 68 kPa to about 690 kPa. Example catalyst to oil ratios for heavy feeds, measured in weight of catalyst to weight of oil, can range from about 2:1 to about 20:1. Catalyst to oil ratios for heavy feeds from about 5:1 to about 10:1 provide the best results for making transportation fuels.

The risers in the dual riser process described herein include a fluidized catalytic cracking zone for light hydrocarbon feedstocks. Such catalytic cracking units may be of the type designed to enhance propylene yields from FCC feedstocks. One such catalytic cracking unit, increasing propylene yields by combining the effects of catalyst formulations containing high levels of ZSM-5 and dual riser hardware technology, includes a high severity riser designed to crack surplus naphtha or other light hydrocarbon streams into light olefins.

Another form of FCC technology useful in one or both of the dual risers described herein is a process that employs a fluidized catalytic reactor to convert light hydrocarbons, generally in the $C_4$ to $C_8$ range, to a higher value product stream rich in propylene. This FCC technology is available by license from Kellogg Brown & Root under the designation SUPERFLEX. SUPERFLEX technology is a process that employs a fluidized catalytic reactor to convert light hydrocarbons, generally in the $C_4$ to $C_8$ range, to a higher value product stream rich in propylene. Streams with relatively high olefins content are the best feeds for the SUPERFLEX reactor. Thus, olefins plant by-product $C_4$ and $C_5$ cuts, either partially hydrogenated or as raffinate from an extraction process, are excellent feeds for this type of FCC unit. One of the benefits of the process is its ability to process other potentially low value olefins-rich streams, such as FCC and coker light naphthas from the refinery. These streams, in consideration of new motor gasoline regulations regarding vapor pressure, olefins content and oxygenate specifications, may have increasingly low value as blend stock for gasoline, but are good feeds for the SUPERFLEX reactor. In addition to propylene, the process also produces byproduct ethylene and a high octane, aromatic gasoline fraction which adds more value to the overall operating margin.

FCC naphtha (such as, light cat naphtha) can be re-cracked in the presence of one or more zeolitic catalysts such as ZSM-5, with relatively high catalyst-to-oil ratios and high riser outlet temperatures, to produce olefins. For maximum olefin yields from light olefinic feeds (such as recycled cracked naphtha), the riser operates at a riser outlet temperature of approximately 590° C. to 675° C.; from mixed olefinic $C_4$'s at a riser outlet temperature of approximately 550° C. to 650° C.; or from olefinic $C_5$'s with a riser outlet temperature of approximately 650° C. to 675° C. The operating pressure for light olefinic feeds generally ranges from about 40 kPa to about 700 kPa. Example catalyst-to-oil ratios for light olefinic feeds, measured in weight of catalyst to weight of oil from about 5:1 to about 70:1, wherein catalyst-to-oil ratios for light olefinic feeds from about 12:1 to about 18:1 provide best results for making propylene.

For maximum olefin yields from light paraffinic feeds such as non aromatic raffinate from an aromatic extraction unit, the riser operates at a riser outlet temperature of approximately 620° C. to 720° C.; and from paraffinic feeds such as pentanes, at a riser outlet temperature of approximately 620° C. to 700° C. The operating pressure for light paraffinic feeds generally ranges from about 40 kPa to about 700 kPa. Example catalyst-to-oil ratios for light paraffinic feeds, measured in weight of catalyst to weight of oil, generally range from about 5:1 to about 80:1, wherein catalyst-to-oil ratios for light paraffinic feeds from about 12:1 to about 25:1 provide best results for making propylene.

The combination of high temperature and high levels of ZSM-5 allow the gasoline-range light olefins and/or light paraffins to crack. The high riser outlet temperature and the high heat of reaction maximize the effectiveness of the catalyst.

The reactor (converter) is comprised of four sections: riser/reactor, disengager, stripper and regenerator. Associated systems for the reactor can be standard FCC systems and include air supply, flue gas handling and heat recovery. Reactor overheads can be cooled and washed to recover entrained catalyst, which is recycled back to the reactor. The net overhead product can be routed to the primary fractionator in the olefins plant, although, depending on the available capacity in a given plant, the reactor effluent could alternately be further cooled and routed to an olefins plant cracked gas compressor, or processed for product recovery in some other conventional manner.

In an embodiment, one or both of the FCC risers in the dual riser unit can process a light feed with a coke precursor, wherein the light feedstock is as described above and produces insufficient coke for heat balanced operation, and the coke precursor is present to supply sufficient coke to facilitate heat-balancing both risers, or at least to reduce the amount of supplemental fuel required for heat balancing. An advantage of using a heavy feedstock as a supplemental coke precursor is that some heavy oil can be produced to aid in fines recovery, replacing some or all of any supplemental import oil (such as fuel oil) that can be used in recovering fines from the light feed riser effluents.

In an embodiment, the coke precursor can be a heavy feedstock such as a refinery stream boiling in a temperature range of from about 650° C. to about 705° C. In an embodiment, the heavy feedstock can be a refinery stream boiling in a range from about 220° C. to about 645° C. In an embodiment, the refinery stream can boil at temperatures from about 285° C. to about 645° C. at atmospheric pressure. The hydrocarbon fraction boiling at a temperature ranging from about 285° C. to about 645° C. is generally referred to as a gas oil boiling range component while the hydrocarbon fraction boiling at a temperature ranging from about 220° C. to about 645° C. is generally referred to as a full range gas oil/resid fraction or a long resid fraction.

Hydrocarbon fractions boiling at a temperature of below about 220° C. are generally more profitably recovered as transportation fuels such as gasoline. Hydrocarbon fractions boiling at a temperature ranging from about 220° C. to about 355° C. are generally more profitably directed to transportation fuels such as distillate and diesel fuel product pools, but can be, depending on refinery economics, directed to a fluid catalytic cracking process for further upgrading to gasoline. Hydrocarbon fractions boiling at a temperature of greater than about 535° C. are generally regarded as residual fractions. Such residual fractions commonly contain higher proportions of components that tend to form coke in the fluid catalytic cracking process. Residual fractions generally contain higher concentrations of undesirable metals such as nickel and vanadium, which further catalyze the formation of coke. While upgrading residual components to higher value, lower boiling hydrocarbons is often profitable for the refiner, the deleterious effects of higher coke production, such as higher regenerator temperatures, lower catalyst to oil ratios, accelerated catalyst deactivation, lower conversions, and increased use of costly flushing or equilibrium catalyst for metals control must normally be weighed against these benefits.

Typical gas oil and long resid fractions are generally derived from any one or more of several refinery process sources including but not limited to a low, medium, or high sulfur crude unit atmospheric and/or vacuum distillation tower, a delayed or fluidized coking process, a catalytic hydrocracking process, and/or a distillate, gas oil, or resid hydrotreating process. Moreover, fluid catalytic cracking feedstocks can be derived as by-products from any one of several lubricating oil manufacturing facilities including, but not limited to a lubricating oil viscosity fractionation unit, solvent extraction process, solvent dewaxing process, or hydrotreating process. Moreover, fluid catalytic cracking feedstocks can be derived through recycle of various product streams produced at a fluid catalytic cracking process. Recycle streams such as decanted oil, heavy catalytic cycle oil, and light catalytic cycle oil may be recycled directly or may pass through other processes such as a hydrotreating process prior to use as a coke precursor in the present fluid catalytic cracking process.

The present dual riser, dual light hydrocarbon feed process can, if desired, be integrated with one or more steam pyrolysis units. Integration of the catalytic and pyrolytic cracking units allows for flexibility in processing a variety of feedstocks. The integration allows thermal and catalytic cracking units to be used in a complementary fashion in a new or retrofitted petrochemical complex. The petrochemical complex can be designed to use the lowest value feedstreams available. Integration allows for production of an overall product slate with maximum value through routing of various by-products to the appropriate cracking technology.

Figure 2:
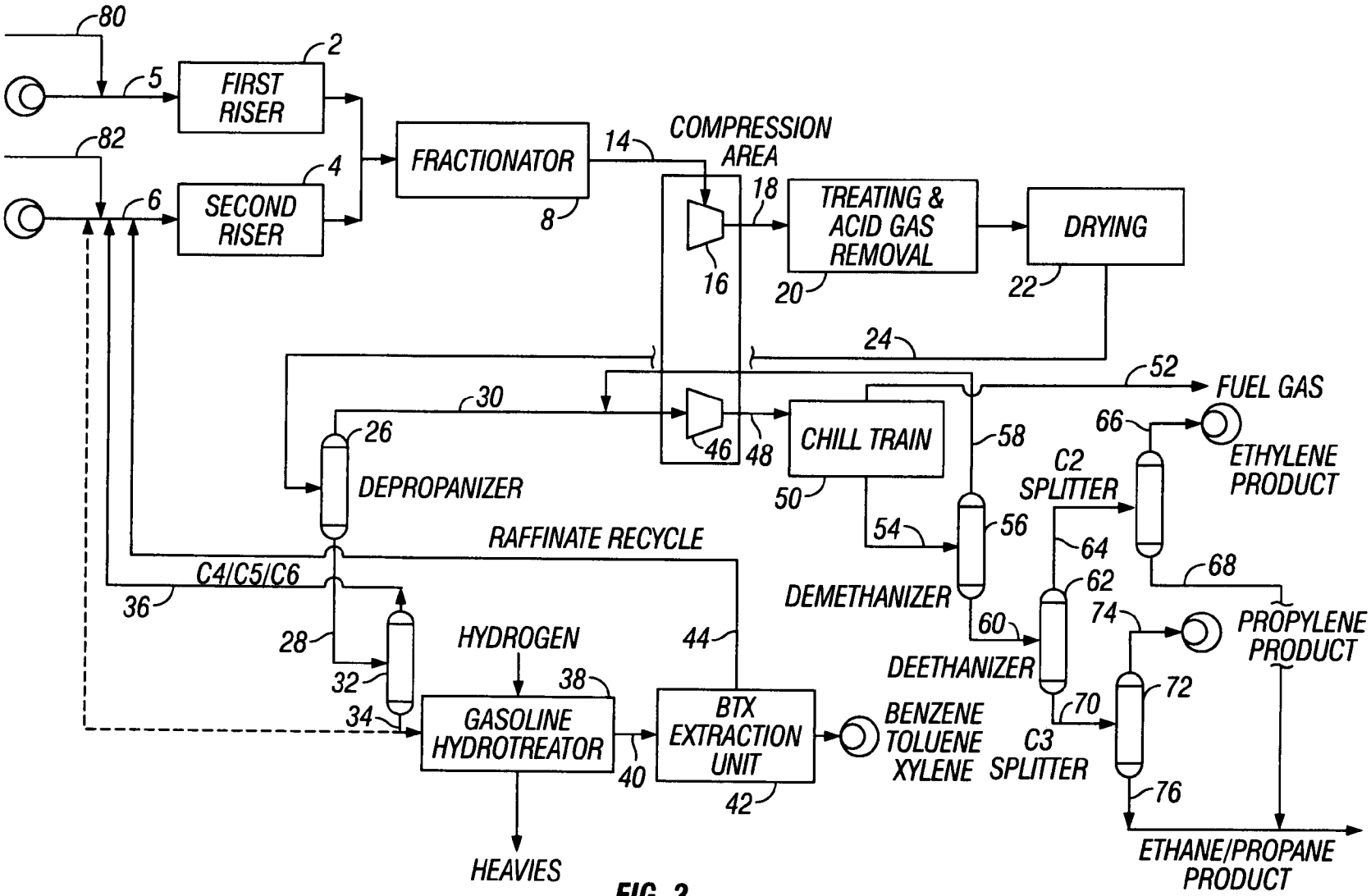
FIG. 2 is a block process flow diagram for an embodiment of a method for incorporating a dual-riser FCC reactor with one or more recycles from downstream processing.

With reference to the figures, FIG. 2 is a block process flow diagram for an embodiment of a method for incorporating a dual-riser FCC reactor with one or more recycles from downstream processing. The embodiment depicted is one incorporating a dual-riser catalytic cracker as exampled in FIG. 1. A first riser 2 and a second riser 4 receive respective first and second light feed streams 5, 6. In an embodiment, the first light feed 5 is an olefinic feed, and the second light feed 6 is paraffinic. In an embodiment, the first light feed 5 includes mixed $C_4$'s and the second light feed 6 includes light olefinic naphtha. If desired, a fresh feed such as light olefinic naphtha can be supplied to the first riser 2, and the second riser 4 is supplied with a feed stream comprising $C_4$, $C_5$, and/or $C_6$ olefins, for example a recycle of effluent stream 36 from the gasoline splitter 32 as described below.

The effluents from the FCC first riser 2 and second riser 4, after catalyst disentrainment (refer to FIG. 1), can be fed to a fractionator 8 for separation of any heavy naphtha and heavier oils to yeild olefin-rich stream 14. Stream 14 is pressurized in compressor 16 to a pressure of from about 100 kPa to about 3500 kPa, depending on the separation scheme (an example range is from 100 kPa to 1500 kPa for a depropanizer-first scheme). The pressurized stream 18 is conventionally subjected to treatment as necessary in unit 20 to remove oxygenates, acid gases and any other impurities from the cracked gas stream, followed by conventional drying in dryer 22. Although the order of fractionation can vary, the dried stream 24 can be fed to depropanizer 26 where the stream is fractionated into a heavier stream 28 containing $C_4$ and gasoline components and a lighter stream 30 containing $C_3$ and lighter components. The heavier stream 28 can be routed to a gasoline splitter 32 where the stream is separated into a gasoline component stream 34 and a $C_4$, $C_5$ and/or $C_6$ effluent stream 36, which can be recycled to the second riser 4. The gasoline component stream 34 can be fed to a gasoline hydrotreater 38 for stabilization, or all or a portion can be recycled to the second riser 4.

In the embodiment exampled in the figures, the treated gasoline stream 40, containing $C_6$ and heavier hydrocarbons, is fed to a BTX unit 42 for recovery of benzene, toluene, and/or xylene components. Any conventional BTX recovery unit is suitable. Exemplary BTX process units are described in U.S. Pat. No. 6,004,452. In the embodiment exampled in FIG. 2, the raffinate recycle stream 44 is fed to the second riser 4. Alternatively, stream 44 can be recycled to a pyrolytic cracker or stream 44 can be a product of the process.

The lighter stream 30 from the depropanizer is compressed in compressor 46 to a pressure of from about 500 kPa to about 1500 kPa to form pressurized stream 48 which is routed to a cryogenic chill train 50. A light stream 52 is removed from the chill train as a fuel gas, a product exported from the process, and/or for further processing such as hydrogen recovery or the like. The heavier stream 54 from the chill train is fed to a series of separators for isolation of olefin streams. The stream 54 can be fed to a demethanizer 56, which produces a light recycle stream 58 and a heavier product stream 60. The light recycle stream 58 can alternatively in whole or in part be a product of the process. The heavier product stream 60 is routed to a deethanizer 62 where it is separated into a light component stream 64 containing ethylene and a heavier stream 70 containing C3 and heavier components. Stream 64 is separated into an ethylene product stream 66 and an ethane stream 68 that can be recycled to a steam pyrolysis unit, or stream 64 can a product of the process. The heavier stream 70 from the deethanizer 62 is routed to a $C_3$ splitter 72 where the stream is split into a propylene product stream 74 and propane stream 76 that can be recycled to a steam pyrolysis unit, or the stream can a product of the process.

If desired, suitable coke precursor can be fed to first riser 2 and/or second riser 4 via respective lines 80, 82.

EXAMPLES

The following examples are based both on pilot plant and laboratory tests, as well as preliminary engineering calculations. The examples demonstrate the novel operation of the dual riser FCC unit in improving overall yields for ethylene and propylene by the segregation of certain feed types and improving the heat balance operation with light feeds. In addition, the examples show the improvement of FCC operations and the maintenance of heat balancing by using certain feeds in one of the risers.

Base Case 1

In this Base Case 1, there are two feedstocks, namely a feed that is predominantly mixed $C_4$s and a feed that is a light olefinic naphtha stream. The mixed $C_4$s stream comprises 68% of the total feed. The compositions of the two separate streams are listed below in Table 1, and the resulting blend of both feeds blended into a combined mixture is also shown.

TABLE 1

Base Case 1 Feed Stream Compositions

| Component, Wt % | Mixed $C_4$s | Light Olefinic Naphtha | Combined Mixture |
|---|---|---|---|
| Linear Butenes | 70.00 | 1.06 | 47.94 |
| Isobutenes | 7.20 | 0.02 | 4.90 |
| n-Butane | 10.50 | 0.19 | 7.20 |
| Isobutane | 12.30 | 0.05 | 8.38 |
| Linear pentenes | | 32.93 | 10.54 |
| Iso pentenes | | 2.76 | 0.88 |
| Linear pentanes | | 3.95 | 1.26 |
| Iso Pentanes | | 9.57 | 3.06 |

TABLE 1-continued

Base Case 1 Feed Stream Compositions

| Component, Wt % | Mixed $C_4$s | Light Olefinic Naphtha | Combined Mixture |
|---|---|---|---|
| $C_5$-$C_{10}$ Naphthenes | | 17.17 | 5.49 |
| $C_6$-$C_{10}$ Aromatics | | 4.90 | 1.57 |
| Other $C_{6+}$ | | 27.38 | 8.76 |
| Total | 100 | 100 | 100 |

The combined mixed feed is sent to a single riser FCC at optimized conditions conducive to maximize ethylene plus propylene production, including a riser temperature of 635° C., a catalyst-to-oil ratio of 15:1, and 10 wt % steam, based on the total weight of the hydrocarbons. The result is that the FCC riser reactor will give the following yields presented in Table 2.

TABLE 2

Base Case 1 Mixed Feed Riser Effluent Yields

| Component | Wt % |
|---|---|
| Ethylene | 9.32 |
| Propylene | 21.70 |
| Total (Ethylene plus Propylene) | 31.02 |

Example 1

To show the effect of cracking the two different feeds separately instead of as a mixed feed as in the Base Case, a dual riser FCC unit is used in Example 1. The mixed $C_4$s and the light olefinic naphtha stream are cracked separately, but under similar conditions as in the Base Case. The resulting yields compare to the Base Case as follows in Table 3.

TABLE 3

Dual Risers vs. Single Riser

| Parameter | Base Case 1 | Example 1 - Dual Rise | |
|---|---|---|---|
| Riser | Single Riser | Riser 1 | Riser 2 |
| Feed | Combined | Mixed $C_4$s | Light Olefinic Naphtha |
| Rise Temp (deg.C.) | 631 | 633 | 632 |
| Catalyst:oil (wt) | 15:1 | 15:1 | 15:1 |
| Steam (wt %) | 10 | 10 | 10 |
| Ethylene, wt % in combined effluent | 9.32 | 12.91 | |
| Propylene, wt % in combined effluent | 21.70 | 22.93 | |
| Total Ethylene plus Propylene, wt % in effluent | 31.02 | 35.84 | |

Separate cracking in dual risers can maximize total ethylene and propylene yields. In the example above, there is about a 15% relative increase in the ethylene plus propylene in the dual riser outlet of Example 1 compared to the Base Case.

The addition of certain hydrocarbon species into the mixed C4 feed affects the reaction of the C4 components to higher yields. Mechanistically, there could be certain classes of compounds that could sterically hinder the feed components from reaching the active sites of the catalyst. For example, mixed C4s have small molecule sizes, and do not contain any ringed compounds such as naphthenes or aromatics. As such, C4 molecules are relatively easy to crack with high ethylene and propylene yields.

By contrast, the light olefinic naphtha stream contains ringed compounds, which could more readily absorb on active sites of the catalyst compared to mixed C4s, which could hinder the more favorable reaction of the C4 components when processed together in a mixed feed stream. Hence, the result that a mixture of C4s/light olefinic naphtha gives inferior ethylene and propylene yields, compared to the separate cracking of mixed C4s and light olefinic naphtha in dual risers, might be explained by this theory.

Although this example presents data on the possible effect of ring compounds in sterically blocking active sites, other compounds such as, but not limited to, branched compounds, alcohols, ketones, multi-ringed compounds, heavy feeds such as gas oil and resids, and the like could have a similar effect. If so, such feeds should be cracked separately from the more easily cracked feeds.

Example 2

Example 2 shows performance enhancement of the dual riser with light feeds with regards to the system heat balance. The two feeds in Example 1 are relatively light feeds, and especially at conditions which optimize the ethylene and propylene yields, very little coke is made. Over the operating conditions conducive to maximum ethylene plus propylene yields, less than 1 wt % of the feed is converted to coke. It is thus necessary to bring heat into the system to satisfy the overall system heat demand. One method is to import fuel to burn in the regenerator to meet overall system heat balance requirements. At a total fresh feed rate of 60,000 kg/hr, a total of 31 Gcal/hr of equivalent fuel is required in Example 1 to heat balance the system. This can be supplied as fuel gas produced in the unit, and fuel oil imported into the unit, in an even split.

An alternate means of providing heat into the system is by injecting a coke precursor into one of the risers, in this case the riser with the light olefinic naphtha in Example 1. For example, diolefinic materials such as butadiene have a significant propensity to make first coke but could also react partially to aromatics at FCC cracking conditions. As much as 50% of the butadiene can be converted to coke in the riser reactor. If so, injection of about 2,000 kg/hr of butadiene should make enough coke to satisfy about half of the external heat balance requirements of Example 1, thereby eliminating the fuel gas import into the regenerator as summarized in Table 4.

TABLE 4

System Heat Balance With Butadiene Coke Precursor

| | Example 1 | | Example 2 | |
|---|---|---|---|---|
| Coke Precursor | None | | Butadiene | |
| Riser | Riser 1 | Riser 2 | Riser 1 | Riser 2 |
| Feed | Mixed C4's | Light Olefinic Naphtha | Mixed C4's | Light Olefinic Naphtha plus 15 wt % butadiene |
| Riser T, ° C. | 633 C. | 632 C. | 633 C. | 632 C. |
| Catalyst:oil, wt | 15:1 | 15:1 | 15:1 | 15:1 |
| Steam, wt % | 10 | 10 | 10 | 10 |

TABLE 4-continued

| System Heat Balance With Butadiene Coke Precursor | | |
|---|---|---|
| | Example 1 | Example 2 |
| System Heat Balance | | |
| Delta coke, wt % | 1 | 1.5 |
| Coke, Gcal/hr | 15.5 | 23.25 |
| Fuel gas, Gcal/hr | 7.75 | 0 |
| Fuel oil, Gcal/hr | 7.75 | 7.75 |
| Total heat, Gcal/hr | 31 | 31 |

Such process modifications make the regenerator simpler and less costly by eliminating a gas injection ring for the fuel gas. Also, the butadiene should not be injected in the riser with a mixed $C_4$s feed because the production of high aromatics from butadiene could suppress the more favorable reactions to ethylene and propylene. As an alternative, the injection of butadiene should be in the riser with feed that already contains ringed compounds (such as, the light olefinic naphtha).

Example 3

Other feeds that lead to coke precursors can be used. In Examples 1 and 2, one of the feeds is light olefinic naphtha, which is partly derived from conventional steam cracking operations. This feed originally contained large amounts of $C_5$ diolefins, which were selectively hydrogenated to $C_5$ mono-olefins to increase the ethylene and propylene yield. $C_5$ diolefins could be provided in the light olefinic feed either by limiting the extent of hydrogenation of the original feed, or by mixing the original feed with selectively hydrogenated feed. The $C_5$ diolefins would accomplish the same goal of injecting butadiene into the riser to make coke for heat balance purposes.

The total feed for the simulation in Examples 2-3 was 60,000 kg/hr, of which 19,200 kg/hr was the light olefinic naphtha feed selectively hydrogenated to essentially less than 0.1 wt % $C_5$ diolefins to improve the yield. However, the severity of the selective hydrogenation unit can be decreased, allowing more $C_5$ diolefins to remain in the feed. With a level of 10-12 wt % $C_5$ diolefins in the light olefinic naphtha feed, the effect on heat balance would be similar to Example 3 as summarized in Table 5.

TABLE 5

| System Heat Balance With $C_5$ Diolefins Coke Precursor. | | | | |
|---|---|---|---|---|
| | Example 1 | | Example 3 | |
| Coke Precursor | None | | $C_5$ Diolefins | |
| Riser | Riser 1 | Riser 2 | Riser 1 | Riser 2 |
| Feed | Mixed $C_4$'s | Light Olefinic Naphtha | Mixed $C_4$'s | Light Olefinic Naphtha plus 11 wt % $C_5$ Diolefins |
| Riser T, ° C. | 633 | 632 | 633 | 632 |
| Catalyst:oil, wt | 15:1 | 15:1 | 15:1 | 15:1 |
| Steam, wt % | 10 | 10 | 10 | 10 |
| System Heat Balance | | | | |
| Delta coke, wt % | 1 | | 1.5 | |
| Coke, Gcal/hr | 15.5 | | 23.25 | |

TABLE 5-continued

| System Heat Balance With $C_5$ Diolefins Coke Precursor. | | |
|---|---|---|
| | Example 1 | Example 3 |
| Fuel gas, Gcal/hr | 7.75 | 0 |
| Fuel oil, Gcal/hr | 7.75 | 7.75 |
| Total heat, Gcal/hr | 31 | 31 |

Example 4

Vacuum gas oils and resids make large amounts of coke, about 15% based upon feed, at FCC conditions favorable for ethylene and propylene production. As such, a heavy feed can also be introduced in one of the dual risers to help in making coke for heat balance purposes. Refer to Table 6.

TABLE 6

| System Heat Balance With Heavy Oil Coke Precursor | | | | |
|---|---|---|---|---|
| | Example 1 | | Example 3 | |
| Coke Precursor | None | | Heavy Oil | |
| Riser | Riser 1 | Riser 2 | Riser 1 | Riser 2 |
| Feed | Mixed $C_4$'s | Light Olefinic Naphtha | Mixed $C_4$'s | Light Olefinic Naphtha plus 15 wt % Resid |
| Riser T, ° C. | 633 | 632 | 633 | 632 |
| Catalyst:oil, wt | 15:1 | 15:1 | 15:1 | 15:1 |
| Steam, wt % | 10 | 10 | 10 | 10 |
| System Heat Balance | | | | |
| Delta coke, wt % | 1 | | 1.5 | |
| Coke, Gcal/hr | 15.5 | | 23.25 | |
| Fuel gas, Gcal/hr | 7.75 | | 0 | |
| Fuel oil, Gcal/hr | 7.75 | | 7.75 | |
| Total heat, Gcal/hr | 31 | | 31 | |

Example 5

Ethylene and propylene yields can be increased with a dual riser FCC unit operating at different conditions because of the nature of the feeds. Example 1 above demonstrated this with a mixed C4s olefinic feed and an olefinic naphtha stream containing ringed components. A further discovery is that feeds that are predominantly olefinic have different cracking characteristics than feeds that are paraffinic. It is found, for example that highly olefinic feeds can be cracked at high conversion at moderate conditions to maximum ethylene plus propylene in an FCC riser reactor. It is not necessary to reduce the hydrocarbon partial pressure by adding large amounts of diluent, to increase the catalyst/oil ratio, or to have high riser outlet temperatures.

By contrast, paraffinic feeds are more stable and more difficult to convert to ethylene and propylene in the FCC riser reactor. Predominantly paraffinic feeds require higher temperatures, higher catalyst/oil ratios and lower hydrocarbon partial pressures to maximize ethylene plus propylene yields compared to olefinic feeds.

Figure 3:
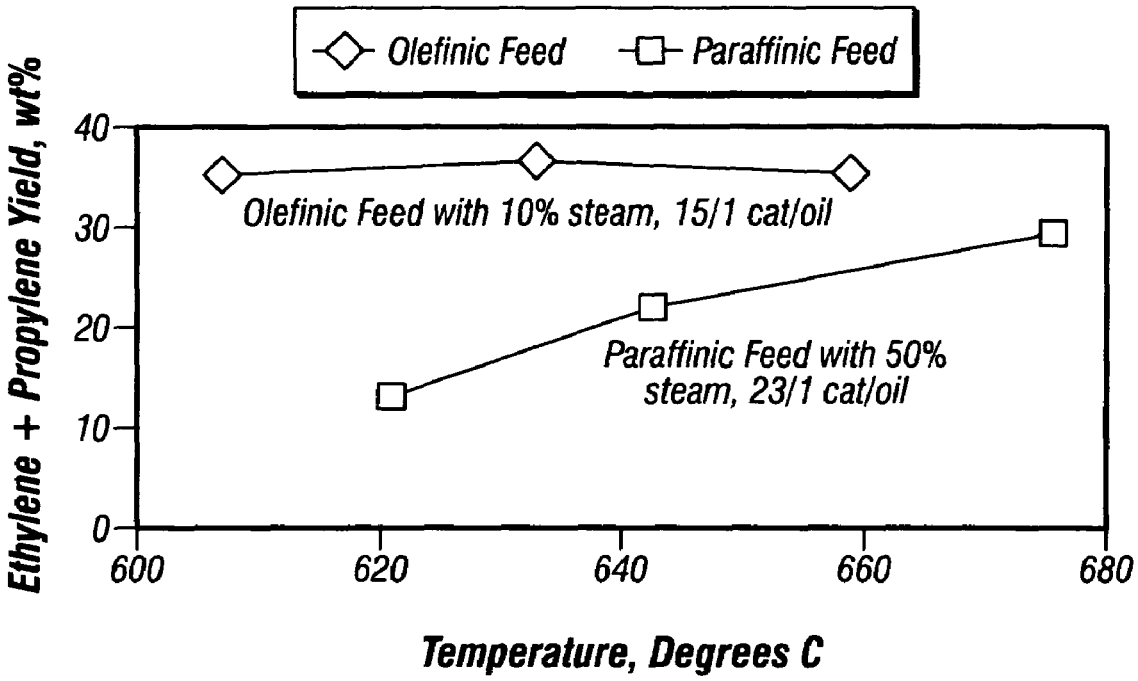
FIG. 3 is a graphical comparison of propylene plus ethylene yields as a function of riser temperature between a paraffinic feed and an olefinic feed at typical propylene-maximizing operating conditions (olefinic feed with 0.1 percent steam, by weight of the oil, and a 15:1 catalyst-to-oil ratio; paraffinic feed with 0.5 percent steam, by weight of the oil, and a 23:1 catalyst-to-oil ratio).

As an example, FIG. 3 is a graphical comparison of propylene plus ethylene yields as a function of riser temperature between a paraffinic feed and an olefinic feed at typical propylene-maximizing operating conditions (olefinic feed with 0.1 percent steam, by weight of the oil, and a 15:1 catalyst-to-oil ratio; paraffinic feed with 0.5 percent steam, by weight of the oil, and a 23:1 catalyst-to-oil ratio). FIG. 3 depicts ethylene plus propylene yields for a feed containing 68% olefins compared to a feed containing 90% paraffins as indicated in Table 7.

TABLE 7

Paraffinic/Olefinic Feedstock Compositions

| Component, Wt % | Feedstock: Paraffinic Feed | Olefinic Feed | Combined Mixture |
|---|---|---|---|
| $C_3$'s | 0.02 | 0.41 | 0.22 |
| Butadiene | | 0.03 | 0.02 |
| Linear Butenes | 0.05 | 41.48 | 20.77 |
| Isobutenes | | 26.42 | 13.21 |
| n-Butane | 1.83 | 8.01 | 4.92 |
| Isobutane | 0.57 | 23.65 | 12.11 |
| Linear pentenes | 1.48 | | 0.74 |
| Isopentenes | | | |
| Linear pentanes | 16.23 | | 8.12 |
| Isopentanes | 14.47 | | 7.24 |
| $C_5$-$C_{10}$ Naphthenes | 0.92 | | 0.46 |
| $C_6$-$C_9$ Olefins | 2.40 | | 1.20 |
| $C_6$-$C_9$ Paraffins | 51.08 | | 25.54 |
| $C_6$-$C_9$ Aromatics | 2.78 | | 1.39 |
| Other $C_6$+ | 8.17 | | 4.09 |
| Total | 100.00 | 100.00 | 100.00 |

Co-mixing a predominantly olefinic feed and a predominantly paraffinic feed will result in an inferior design with a single riser. If the single riser reactor is operated to maximize yields from the olefinic feed, the paraffinic feed components will be under cracked and give poor overall ethylene plus propylene yields. Conversely, if the single riser reactor is operated to maximize yields from the paraffinic feed, the olefinic species will be over cracked and corresponding ethylene plus propylene yields will decline. The solution in this example is a dual riser design, with each riser optimized at different operating conditions for the specific feed to each riser, as summarized in Table 8.

TABLE 8

Separate Risers for Paraffinic/Olefinic Feeds.

| Parameter | Base Case 2 | Example 5 - Dual Riser | |
|---|---|---|---|
| Riser | Single Riser | Riser 1 | Riser 2 |
| Feed | Combined | Paraffinic Feed | Olefinic Feed |
| Riser T, ° C. | 659 | 677 | 633 |
| Catalyst:oil, wt | 19:1 | 23:1 | 15:1 |
| Steam, wt % | 30 | 50 | 10 |
| Ethylene, wt % in combined effluent | 11.73 | 12.92 | |
| Propylene, wt % in combined effluent | 18.76 | 20.08 | |
| Total Ethylene plus Propylene, wt % in effluent | 30.49 | 33.00 | |

Example 6

Example 5 can arise when two different types of feeds from different sources are available to the dual riser FCC unit. This situation can also arise when there is only a single net feed to the FCC unit. In this case, although much of the olefins in the feed are converted, the effluent from the riser reactor still contains hydrocarbon species that can be recycled back to the reactor. In recycle mode of operation, certain hydrocarbon species will buildup in the recycle loop, especially when the conversion of these species is relatively lower, compared to the conversion of olefinic species.

In Example 6, a fresh feed predominantly comprised of C5-C8 components with an olefins content of 52 wt % is sent to an FCC riser reactor. The resulting reactor effluent shows that there are still mixed C4s, mixed C5s, and a C6 non-aromatic stream which can be recycled back to the reactor to increase the ultimate yield of ethylene and propylene. The C4, C5 and C6 recycle stream components will build up to steady state rate and composition with an olefins content of only about 32 wt %. The fresh feed contains 52% olefins, while the recycle feed contains 32%, as summarized in Table 9.

TABLE 9

Example 6 Olefinic/Recycle Feedstock Compositions.

| Component, Wt % | Feedstock: Fresh Olefinic Feed | Steady State Recycle | Combined Mixture |
|---|---|---|---|
| $C_3$'s | 0.02 | 0.41 | 0.22 |
| Butadiene | | 0.03 | 0.02 |
| Linear Butenes | 5.59 | 3.4 | 4.60 |
| Isobutenes | | 14.0 | 6.35 |
| n-Butane | 0.91 | 9.8 | 4.94 |
| Isobutane | 2.11 | 5.6 | 3.69 |
| Linear pentenes | 34.65 | 7.9 | 22.52 |
| Isopentenes | | | 0.00 |
| Linear pentanes | 8.48 | 11.5 | 9.85 |
| Isopentanes | 23.53 | 32.8 | 27.73 |
| $C_5$-$C_{10}$ Naphthenes | 0.93 | | 0.51 |
| $C_6$-$C_9$ Olefins | 11.55 | 6.3 | 9.17 |
| $C_6$-$C_9$ Paraffins | 9.07 | 6.2 | 7.77 |
| $C_6$-$C_9$ Aromatics | 0.23 | 2.5 | 1.26 |
| Other $C_6$+ | 2.95 | | 1.61 |
| Total | 100.00 | 100.00 | 100.00 |

The two streams are cracked separately under different conditions to optimize operations in each riser, following the principles set forth in Example 5. The overall propylene plus ethylene yields are increased relative to feeding the recycle and fresh feed streams to the same riser.

TABLE 10

Separate Risers for Olefinic Feed/Recycle.

| Parameter | Base Case 3 | Example 6 - Dual Riser | |
|---|---|---|---|
| Riser | Single Riser | Riser 1 | Riser 2 |
| Feed | Combined | Fresh Olefinic | Recycle |
| Riser T, ° C. | 635 | 632 | 651 |
| Catalyst:oil, wt | 23:1 | 16:1 | 22:1 |
| Steam, wt % | 10 | 10 | 10 |
| Ethylene, wt % in combined effluent | 10.17 | 10.87 | |
| Propylene, wt % in combined effluent | 16.64 | 18.56 | |
| Total Ethylene plus Propylene, wt % in effluent | 26.81 | 29.43 | |

The fluidized catalytic cracking processes described herein can be used in an arrangement for integrating cracking operations and petrochemical derivative processing operations.

While these embodiments have been described with emphasis on the embodiments, it should be understood that within the scope of the appended claims, the embodiments might be practiced other than as specifically described herein.

What is claimed is:

1. A dual riser FCC process, comprising:

cracking a first hydrocarbon feed having a carbon number less than 12 in a first riser under first-riser FCC conditions to form a first effluent enriched in ethylene, propylene or a combination thereof;

cracking a second hydrocarbon feed having a carbon number less than 12 in a second riser under second-riser FCC conditions to form a second effluent enriched in ethylene, propylene or a combination thereof, wherein the first hydrocarbon feed comprises mixed olefinic $C_4$'s and the second hydrocarbon feed comprises mixed paraffinic $C_4$'s and the first-riser and second-riser FCC conditions are independently selected to favor production of ethylene, propylene or a combination thereof;

recovering catalyst and separating gas from the first and second FCC effluents;

regenerating the recovered catalyst by combustion of coke in a regenerator to obtain hot, regenerated catalyst;

recirculating the hot regenerated catalyst to the first and second risers to sustain a continuous operating mode; and introducing a coke precursor to the first or second riser with the respective first or second hydrocarbon feed at a ratio of from 1 to 40 parts by weight coke precursor to 100 parts by weight fresh hydrocarbon feed, wherein the coke precursor is selected from the group consisting of acetylene, substituted acetylene, and mixtures thereof with diolefins.

2. The process of claim 1 wherein the first hydrocarbon feed further comprises light olefinic naphtha, heavy olefinic naphtha, mixed olefinic $C_5$'s and combinations thereof.

3. The process of claim 1, wherein the second hydrocarbon feed further comprises light paraffinic naphtha, heavy paraffinic naphtha, mixed paraffinic $C_5$'s, mixed paraffinic and cycloparaffinic $C_6$'s, and combinations thereof.

4. The process of claim 1, wherein the first-riser and second-riser FCC conditions are different, wherein the different conditions are selected from catalyst-to-oil ratio, hydrocarbon partial pressure, steam-to-oil ratio, and a combination thereof.

5. The process of claim 4, wherein the second-riser FCC conditions include a higher catalyst-to-oil ratio, and lower hydrocarbon partial pressure than the first-riser FCC conditions.

6. The process of claim 5, wherein the second hydrocarbon feed comprises a recycle stream recovered from the separated gas.

7. The process of claim 6, wherein the recycle stream comprises paraffinic and cycloparaffinic hydrocarbons having from 4 to 12 carbon atoms.

8. The process of claim 1, wherein the regenerating the recovered catalyst further comprises combustion of supplemental fuel introduced to the regenerator, to maintain a steady state heat balance.

9. The process of claim 8, wherein the supplemental fuel comprises fuel oil or fuel gas.

10. The process of claim 1, wherein the first hydrocarbon feed comprises mono-olefins and from 1 to 15 weight percent diolefins.

11. The process of claim 1, wherein the coke precursor further comprises a heavy hydrocarbon feed.

12. The process of claim 1, wherein the coke precursor further comprises an aromatic or aromatic precursor, wherein the second-riser FCC conditions include a higher catalyst-to-oil ratio, and lower hydrocarbon partial pressure than the first-riser FCC conditions, and wherein the coke precursor is introduced to the first riser.

13. The process of claim 1, wherein the coke precursor further comprises waxy gas oil, wherein the second-riser FCC conditions include a higher catalyst-to-oil ratio, and lower hydrocarbon partial pressure than the first-riser FCC conditions, and wherein the coke precursor is introduced to the second riser.

14. The process of claim 1, wherein coke on the recovered catalyst from the hydrocarbon feeds is insufficient by itself, the introduction of the coke precursor provides additional coke make, and the regeneration further comprises combustion of supplemental fuel introduced to the regenerator, to maintain a steady state heat balance.

15. The process of claim 1, wherein coke on the recovered catalyst the hydrocarbon feeds is insufficient by itself, and the introduction of the coke precursor is controlled at a rate to provide additional coke make to maintain a steady state heat balance.

* * * * *